United States Patent [19]

Block

[11] Patent Number: 4,633,541

[45] Date of Patent: Jan. 6, 1987

[54] FLOOR TREATING MACHINE

[75] Inventor: Thomas S. Block, Muskegon, Mich.

[73] Assignee: Cooper Industries, Houston, Tex.

[21] Appl. No.: 647,914

[22] Filed: Sep. 6, 1984

Related U.S. Application Data

[63] Continuation-in-part of Ser. No. 537,730, Sep. 29, 1983, Pat. No. 4,506,405.

[51] Int. Cl.[4] ..... A47L 11/283

[52] U.S. Cl. ..... 15/49 R; 15/50 R; 15/319; 15/320

[58] Field of Search ..... 15/320, 49 R, 49 C, 15/50 R, 50 C, 319, 339

[56] References Cited

U.S. PATENT DOCUMENTS

| | | | |
|---|---|---|---|
| 2,978,719 | 4/1961 | Arones | 15/320 X |
| 3,277,511 | 10/1966 | Little et al. | 15/320 |
| 3,345,671 | 10/1967 | Wilson et al. | 15/320 |
| 3,871,051 | 3/1975 | Collier | 15/321 |
| 3,886,624 | 6/1975 | Landesman et al. | 15/340 |
| 4,009,500 | 3/1977 | Ashton | 15/50 R |
| 4,041,567 | 8/1977 | Burgoon | 15/320 |
| 4,492,002 | 1/1985 | Waldhauser et al. | 15/320 |

*Primary Examiner*—Chris K. Moore

*Attorney, Agent, or Firm*—E. E. Scott; A. R. Thiele

[57] ABSTRACT

A floor treating machine adapted to operate as a floor scrubber and a floor polisher or buffer includes a main housing or support frame structure from which extends a brush housing assembly. The main housing contains a combined solution and recovery tank, a motive device to power the floor treating machine, a propulsion system to propel the floor treating machine along the floor, a pneumatic power system, a squeegee subassembly and electrical and pneumatic control systems therefor. The brush housing assembly is operatively connected to the main housing by a brush lifting mechanism such that two brushes selectively rotating in opposite directions in the brush housing assembly can be lifted away from the floor or moved toward the floor so that the brushes exert the correct amount of pressure against the floor depending on the job being done. The electrical and pneumatic control systems enable the floor treating machine to be selectively operated as a floor scrubber wherein the brushes in the brush housing assembly rotate at a relatively slow rotational speed and wherein the amount of pressure that the brushes exert against the floor is adjustable. The control systems also enable the floor treating machine to be selectively operated as a floor buffer or polisher wherein the brushes are rotated at a relatively high rotational speed and the brushes exert a relatively constant force or pressure against the floor. A high speed polisher is also disclosed capable of attaining rotational brush speeds of 2000 RPM and over. The polisher is controlled by an electric and pneumatic control system.

17 Claims, 8 Drawing Figures

FLOOR TREATING MACHINE

This applcation is a continuation-in-part of U.S. patent application Ser. No. 537,730 filed Sept. 29, 1983, now U.S. Pat. No. 4,506,405, issued Mar. 26, 1985, and assigned to the assignee of the present invention.

BACKGROUND OF THE INVENTION

A. Field of the Invention

The present invention relates to a new and improved floor treating machine, and more particularly, to a new and improved floor treating machine which can be used both as a floor scrubber and a floor polisher. In an alternate embodiment a high speed single purpose floor polishing machine is disclosed. Both machines include electric and pneumatic controls to operate the floor treating machine in the scrubbing and buffing modes or buffing only mode.

B. Description of the Background Art

Floor treating machines presently available are used to scrub a hard floor surface with a cleaning solution. Such machines typically include a solution tank containing the cleaning fluid to be used in the scrubbing operation, a brush head assembly having at least one scrub brush to scrub the floor with the cleaning solution which is automatically metered to the brush heads from the solution tank and a soilage recovery system usually having a squeegee to collect the wet soilage or dirty solution and a vacuum system to pick up the collected wet dirty solution and to deposit the dirty solution in a recovery tank. Some of these machines are self-propelled, battery powered and are referred to as automatic floor scrubbers. The machines normally require only one person to operate and may clean floor surfaces at a rate of 24,000 to 30,000 square feet per hour.

Different aspects of one type of floor scrubber machine presently available is disclosed in U.S. Pat. Nos. 4,218,798; 4,251,896; 4,293,971; and 4,333,202 to Block and assigned to the assignee of the present invention, the disclosures of which are incorporated herein by reference.

U.S. Pat. No. 4,218,798 discloses the aspect of a floor treating machine including a brush subassembly and brush lift assembly. The brush lift assembly includes a lift arm pivoted to the support frame of the machine and a fluid operated diaphragm motor engaging the lift arm for pivoting the lift arm to lift the brush subassembly. The lift assembly either raises or lowers the brush subassembly.

U.S. Pat. No. 4,251,896 discloses the aspect of a gimbal connection for connecting brushes of a floor treating machine to a motor. This connection allows the brushes to shift axis of rotation to accommodate deviations in the surface being treated.

U.S. Pat. No. 4,293,971 is directed to the aspect of a squeegee assembly on a floor treating machine. The use of a coil spring to free a squeegee from direct rigid connection to the floor treating machine is specifically disclosed.

The aspect of a one piece tank for a floor scrubbing apparatus is disclosed in U.S. Pat. No. 4,333,202. The one piece tank defines both a recovery tank portion and a solution tank portion.

There also are presently available floor waxing or polish machines. These machines normally have a single brush and are either self-contained or must be plugged into a source of AC power. One such machine is disclosed in U.S. Pat. No. 2,930,055.

Self contained machines utilize batteries or propane gas as a source of power. Some even use gasoline powered internal combustion engines. However, the gasoline powered machines are not very practical indoors or in confined spaces.

There are available self-contained high speed buffing machines which are capable of attaining brush rotational speeds of 2000 RPM and above. Some battery powered high speed polishing machines are equipped with integral battery chargers which facilitate battery charging and decrease down time.

In most propane gas type machines, the propane gas tank must be removed when empty and replaced with a full tank. Propane gas machines also inherently require more maintenance than the battery powered type. The oil must be checked regularly as well as the spark plugs and the air cleaner on the cooling system.

Some machines which have combined capability for scrubbing and polishing require separate scrubbing and buffing (or waxing) brushes often at different locations on the machine. The resultant machine is bulky and difficult to maneuver during floor treating operations. U.S. Pat. No. 3,204,280 discloses such a machine and also discloses a system for either raising or lowering the brushes. This machine lacks the capability to vary the pressure of these brushes on the surface being treated.

A machine for rotating several brushes at two speeds and either raising or lowering the brushes is disclosed in U.S. Pat. No. 3,942,215. Multiple brushes individually used for only one function are provided and the pressure of the brushes on the surface being treated cannot be varied. A bulky and unwieldy machine is the result.

U.S. Pat. No. 4,173,052 discloses a mechanical linkage system for varying the position of a brush relative to a surface being treated to compensate for wear of the brush. This mechanical system does not function to vary the pressure of the brush on the surface in accordance with the mode of operation of the machine.

A hydraulically operated street cleaning machine with an external power source is disclosed in U.S. Pat. No. 4,138,756. The disclosed machine includes one or more curb brushes and a single main brush the speed and downward pressure of which may be varied to a limited degree. Selective coupling to a power source to vary the speed and downward pressure of two brushes to perform the different functions of scrubbing and buffing is not disclosed.

Conventional dual purpose machines which are capable of both scrubbing and polishing require the operator to manually vary the pressure between the brushes and the floor depending whether the machine is used in the scrubbing or polishing mode. This can be cumbersome for the person operating the machine. Also, there is the risk that the operator may improperly adjust the pressure resulting in a non satisfactory floor finish.

In both dual and single purpose machines, the floor finish is dependent upon the brush rotational speed. Mores brush pressure is exerted during scrubbing as compared to polishing. During the polishing the brush pressure must be optimized with the brush rotational speed. Faster brush rotational speeds are capable when the brush pressure is reduced resulting in a more highly polished, glassy look finish.

Any improvements in floor maintenance machines would be welcomed by the industry. More importantly the lack of an acceptable solution demonstrates that there is a long felt need by the industry which has heretofore eluded those skilled in the art.

SUMMARY OF THE INVENTION

One object of the present invention is to provide a new and improved floor treating machine.

Another object of the present invention is to provide a new and improved floor treating machine that can be used both as a floor scrubber and as a floor polisher or buffer.

A further object of the present invention is to provide a new and improved floor treating machine having a plurality of brushes which are rotated at a relatively slow speed when the floor treating machine is used as a floor scrubber and are rotated at a relatively high speed when the floor treating machine is used as a floor polisher or buffer.

A still further object of the present invention is to provide a new and improved floor treating machine in which the machine has control systems to selectively control the speed of rotation of the brushes and the pressure the brushes exert against a floor when the machine is used either as a floor scrubber or as a floor polisher or a buffer.

Yet another object of the present invention is to provide a new and improved floor treating machine having an electrical and pneumatic control systems to control the speed the floor treating machine is propelled in forward and reverse directions along a floor and to control the speed of the rotation of the brushes and to allow variable control of the pressure which the brushes apply against the floor during the operation of the machine in one mode as a floor scrubber and to provide automatic control of the pressure of the brushes in another mode as a floor polisher.

Another object of this invention is to provide a self contained high speed polishing machine capable of rotational brush speeds of 2000 RPM and over.

Briefly, one aspect the present invention is directed to a new and improved floor treating scrubbing and buffing machine having a main housing or support frame structure from which extends a brush housing assembly. The main housing has disposed therein a combined solution and recovery tank having a portion for cleaning solution to be used by the floor treating machine during the operation of the machine as a floor scrubber and another portion for receiving wet dirty solution vacuumed from the floor by a squeegee assembly. Power to operate the machine may be from several different sources. For example, the housing may contain a bank of batteries to power a propulsion system to propel the floor treating machine along the floor and to power brush and vacuum motors and other controls. The brush housing assembly is operatively connected to the main housing by a brush lifting mechanism such that two brushes rotating in opposite directions in the brush housing assembly can be lifted away from the floor or forced against the floor at appropriate pressures. Electrical and pneumatic control systems enable the floor treating machine to be selectively operated in a floor scrubbing mode wherein the brushes in the brush housing assembly rotate at a relatively slow rate while solution is provided to the brushes for scrubbing the floor and wherein the amount of pressure that the brushes exert against the floor is manually and infinitely adjustable and to be selectively operated in a buffing or polishing mode wherein the brushes are rotated at a relatively high speed and the brushes are automatically operated to exert a relatively constant force or pressure against the floor.

Another aspect of the invention is to provide a high speed buffing machine capable of rotational brush speeds of 2000 RPM and over. The buffing machine is similar to the combined scrubbing and buffing machine just described with the exception that facilities for the scrubbing operation are removed. The buffing machine contains electrical and pneumatic control means for lifting the brush housing away from the floor and for varying the contact pressure between the brushes and the floor.

BRIEF DESCRIPTION OF THE DRAWINGS

The above and other objects and advantages and novel features of the present invention will become apparent from the following detailed description of the preferred embodiments of the invention illustrated in the accompanying drawings wherein.

DETAILED DESCRIPTION OF THE PREFERRED EMBODIMENT

Figure 1:
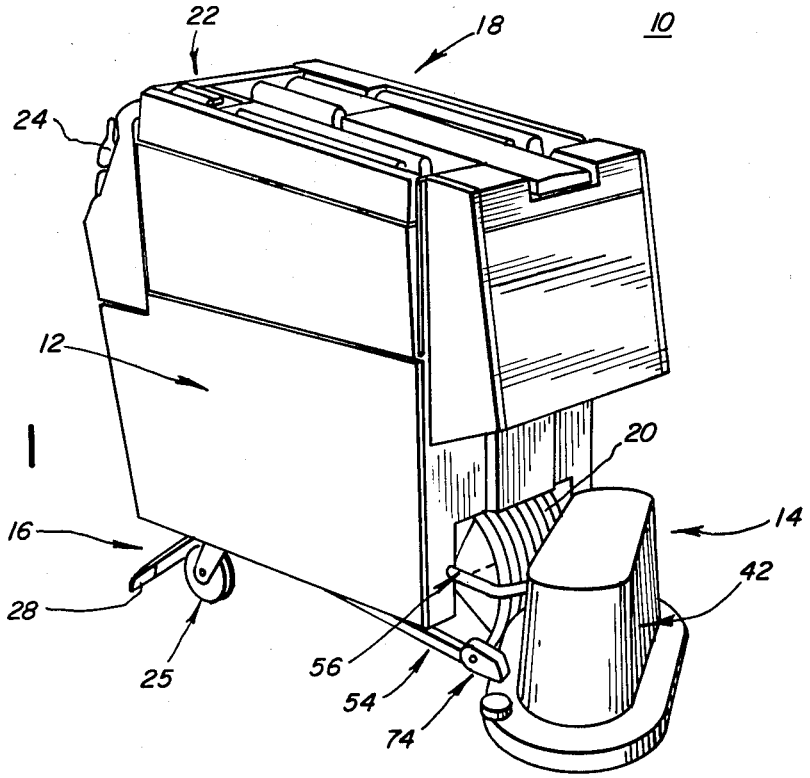
FIG. 1 is a front right side perspective view of an automatic floor treating machine in accordance with the present invention.

While this invention is susceptible of embodiment in many different forms, there are shown in the drawings, which will herein be described in detail, several embodiments of the invention. It should be understood however, that the present disclosure is to be considered an exemplification of the principles of the invention and is not intended to limit the invention to any of the specific embodiments illustrated.

PREFERRED EMBODIMENT

Figure 2:
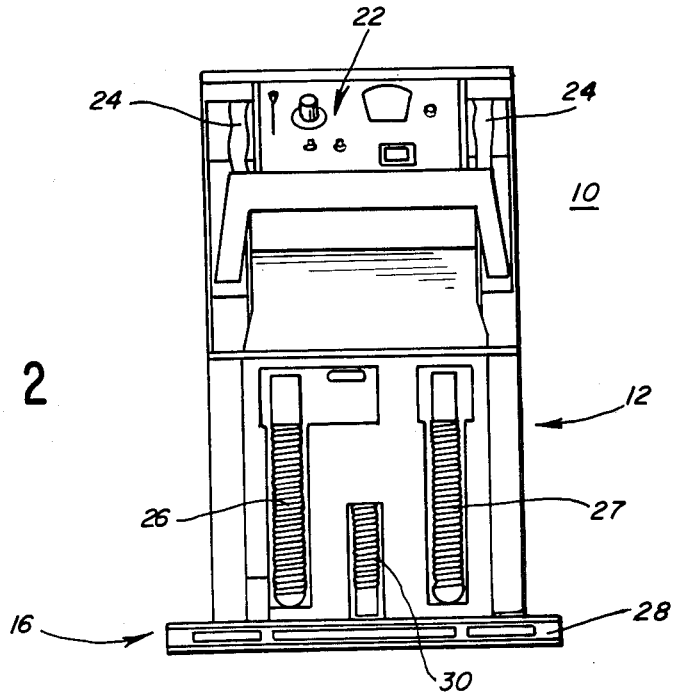
FIG. 2 is a rear elevational view of the floor treating machine of FIG. 1.

Referring to the drawings and initially to FIGS. 1 and 2, there is illustrated a floor treating machine in accordance with the present invention and which is generally designated by the reference numeral 10. The floor treating machine 10 is illustrated as a battery powered, floor treating machine but other power sources may be employed. In the polishing machine, machine 10 includes a paneled main frame structure or housing 12 to which is secured a brush head or housing subassembly generally designated as 14. The combined scrubbing and polishing machine also includes a squeegee subassembly generally designated as 16 and a combined solution and recovery tank generally designated as 18. The housing 12 contains a bank of batteries (not shown, but schematically shown in FIG. 6) which powers the floor treating machine 10 and provides power to rotate a floor engaging drive wheel 20 located at the front of the housing 12. When the drive wheel 20 rotates, the floor treating machine 10 is propelled along a floor surface. The main frame 12 also includes an appropriate operator control panel 22 from which an operator can control many of the functions of the floor treating machine 10 and a pair of control handles 24 which an operator of the floor treating machine 10 utilizes in guiding the floor treating machine 10 as it moves along a floor surface.

The floor treating machine 10 has a three point support composed of the main drive wheel 20 and a pair of laterally positioned and transversely spaced caster wheels 25 located near the rear of the main frame structure 12 (just in front of the squeegee subassembly 16 in the combination machine). As described in more detail in the U.S. Pat. No. 4,333,202, the combined solution and recovery tank 18 in the combination machine permits the use of this three point support because any instability of the housing 12 due to changes in the amount of liquid in the solution and recovery portions of the tank 18 is eliminated. At the rear of the housing 12, drain tubes 26 and 27 are provided so that the solution and recovery portions, respectively, of the tank 18 may be drained.

The squeegee subassembly 16 includes a squeegee 28 located at the rear lower portion of the main frame structure 12. As discussed in detail in the above referred to in U.S. Pat. No. 4,293,971, the squeegee 28 engages a floor surface as the floor treating machine 10 is being used as a floor scrubber to collect cleaning solution which has been used in the floor scrubbing operation and which is directed by the squeegee 28 toward an inlet attached to a flexible tubing 30, through which tubing 30 dirty cleaning solution is pumped into the recovery portion of the tank 18. As will be described hereinafter, the squeegee 28 is raised away from the floor surface when the floor treating machine 10 is used as a floor scrubber or polisher or when the floor treating machine is in a nontreating mode.

Figure 3:
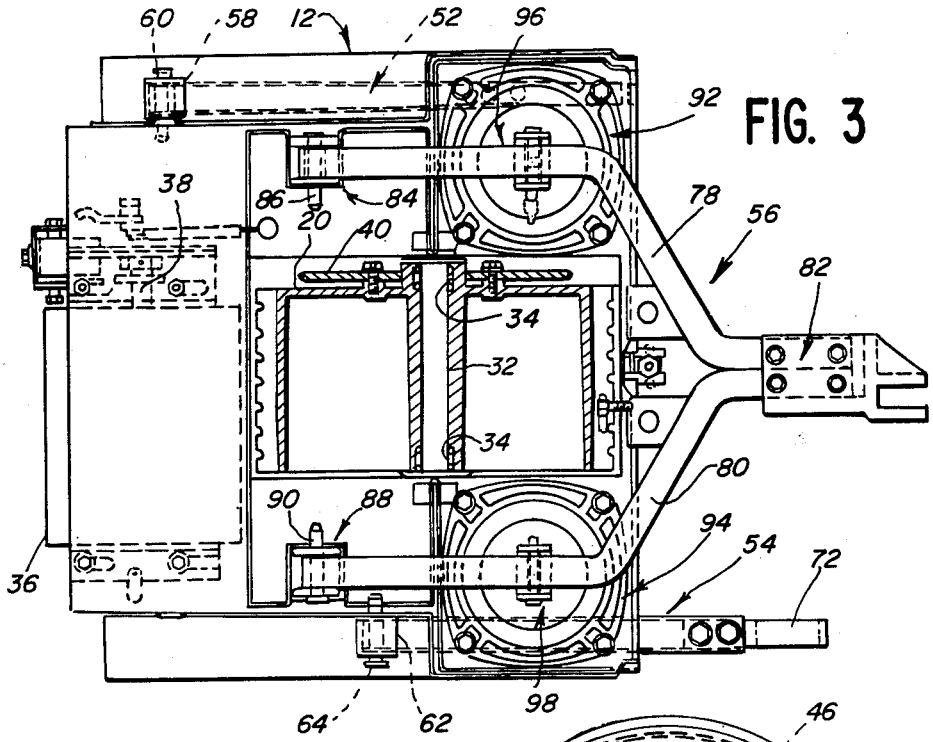
FIG. 3 is a top plan view of the support subassembly portion of the floor treating machine of FIG. 1.

One embodiment of the floor treating machine 10 is a unit which is moved along a floor surface in response to the rotation of the floor engaging wheel 20. The wheel 20 is rotatably mounted on an axle 32 by suitable bearings 34 near the front lower portion of the housing 12 (FIG. 3). As described in more detail in U.S. Pat. No. 4,218,798, the wheel 20 is rotated by means of an electric motor 36 mounted rearwardly of the wheel 20 in the housing 12. The electric motor 36 has an output shaft 38 which through a flexible transmission member, such as a roller chain, drives a sprocket 40 secured to the wheel 20. Consequently, as the sprocket 40 is rotated in response to the energization of the electric motor 36, the wheel 20 is rotated so that the floor treating machine 10 may be moved along in a forward or reverse direction. As will be discussed in more detail hereinafter, the direction and the speed the floor treating machine 10 is propelled along a floor surface is controlled by the operator of the machine primarily through the control handles 24.

Figure 4:
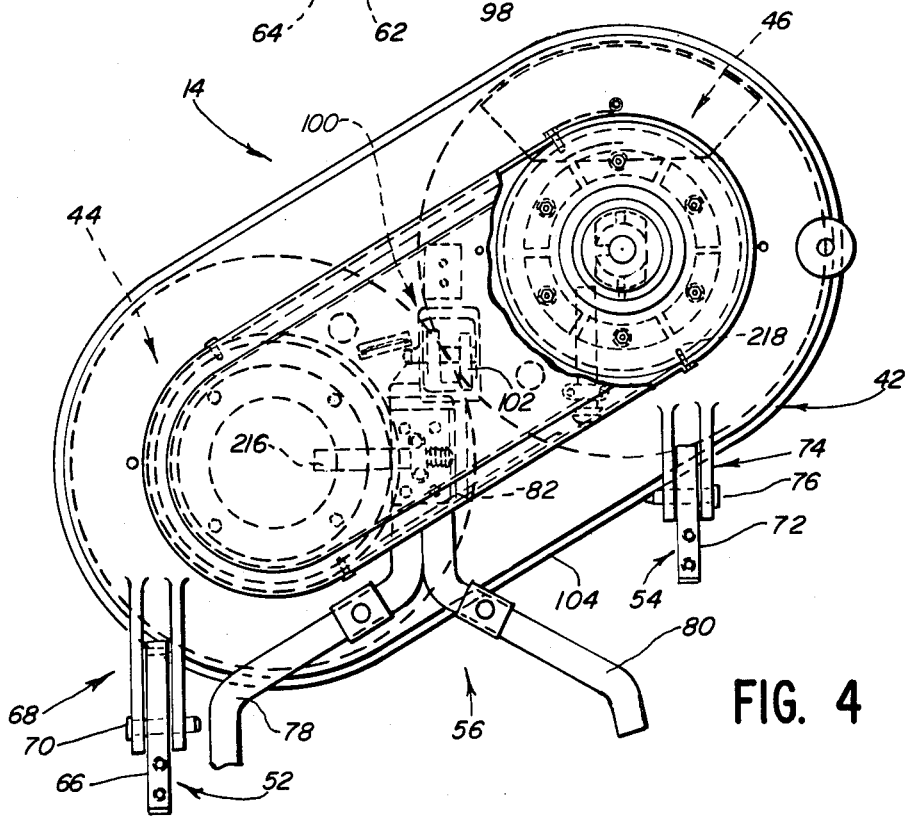
FIG. 4 is a top plan view of brush head subassembly portion of the floor treating machine of FIG. 1.

As best seen in FIG. 4, the brush head assembly 14 is operatively connected in front of the housing 12 and includes a brush housing 42 within which are located vertical axis rotary brushes 44 and 46. The brush 44 is rotated by as brush motor schematically shown as 48 in FIG. 5 and the brush 46 is rotated by a brush motor schematically shown as 50 in FIG. 5. The brush motors 48 and 50 are located above the brushes 44 and 46, respectively, in the brush housing 42. The manner in which the brushes 44 and 46 are connected to the brush motors 48 and 50, respectively, is described in more detail in U.S. Pat. Nos. 4,218,798 and 4,251,896.

As best seen in FIGS. 3 and 4 of the drawings, the brush head assembly 14 is positioned in front of the housing 12 by tilt links or stabilizing arms 52 and 54 and by a brush lift mechanism 56. The stabilizing arm 52 is secured to the undersurface of the main frame structure 12 by a bracket 58 and a pivot pin 60. The stabilizing arm 54 is similarly connected to the undersurface of the housing 12 by a bracket 62 and a pin 64. A front portion 66 of the stabilizing arm 52 is slideably connected to the brush housing 42 by a bracket 68 and a connecting pin 70. Similarly, the stabilizing arm 54 has a forward portion 72 connected to the brush housing 42 by a bracket 74 and a pin 76.

The brush lifting mechanism 56 has a generally Y-shaped or bifurcated member defined by arm sections 78 and 80 joined together by a bracket 82. The arm 78 is pivotally secured to the housing 12 by a bracket 84 and a pin 86. The other arm 80 is connected to the underside of the housing 12 by a bracket 88 and a pin 90. The arms 78 and 80 are positioned above brush lift actuators 92 and 94, respectively. In the embodiment shown, the brush lift actuators are fluid operated diaphram motors. The actuator 92 has a stem 96 pivotally connected to the arm 78 and the actuator 92 has a stem 98 pivotally connected to the arm 80.

The bracket 82 coupling the arm sections 78 and 80 together is pivotally connected to a main lift bracket 100 centrally located in the brush housing 42. The bracket 82 is connected to the bracket 100 by a pivot pin 102. As is described in more detail in U.S. Pat. No. 4,218,798, the stabilizing arms 52 and 54 together with the lifting mechanism 56 maintains the brush housing 42 at an approximately 30° angle in front of the main frame structure 12 so that the areas on the floor engaged by the brushes 44 and 46 overlap each other.

The brush housing 42 can be moved up and down relative to the floor surface by the lifting mechanism 56 as the arms 78 and 80 are moved up and down by the stem portions 96 and 98 of the actuators 92 and 94, respectively. As the brush housing 42 is moved toward the floor, the brushes 44 and 46 will exert greater amounts of pressure or force against the floor surface whereas when the brush housing 42 is moved away from the floor, the brushes 44 and 46 will exert a lesser amount of force against the floor surface. In the combination scrubbing and polishing machine, this force can vary from essentially zero pounds to approximately 80 pounds. In the single purpose polishing machine embodiment, this force can vary from zero to 12 pounds. If desired, the lifting mechanism 56 can lift the brush housing 42 so that the brushes 44 and 46 are not engaging the floor and an operator would have access to the brushes 44 and 46. When the brush housing 42 is so lifted, the brush housing 42 is tilted upwardly relative to a rear or trailing edge 104 of the brush housing 42 due to the pivotal connection of the front portion 66 of the stabilizing arm 52 to the brush housing 42 by the bracket 68 and the front portion 72 of the stabilizing arm 54 to the brush housing 42 by the bracket 74.

Figure 5:
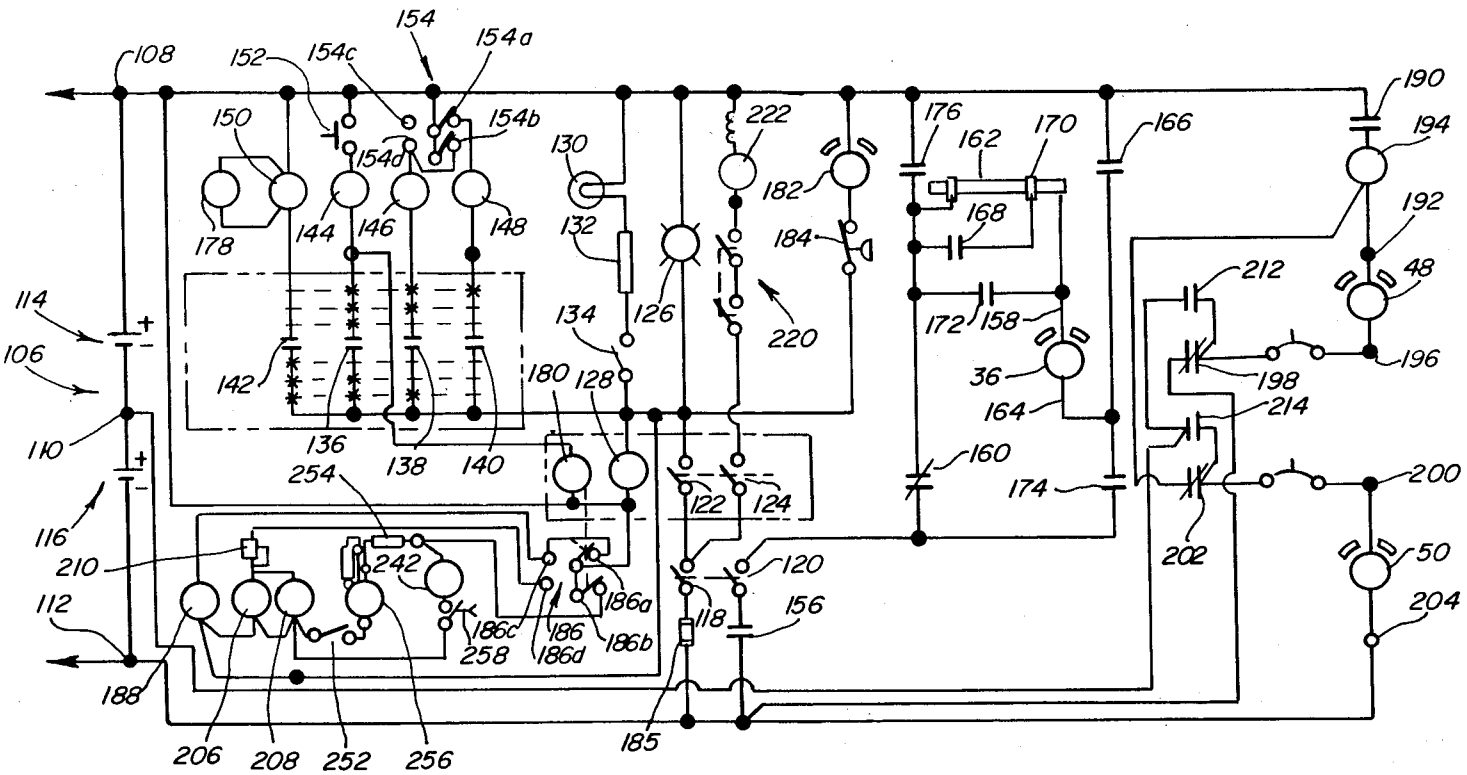
FIG. 5 is a schematic diagram of the electrical control circuit for controlling the operation of the floor scrubbing and buffing machine of FIG. 1.
Figure 6:
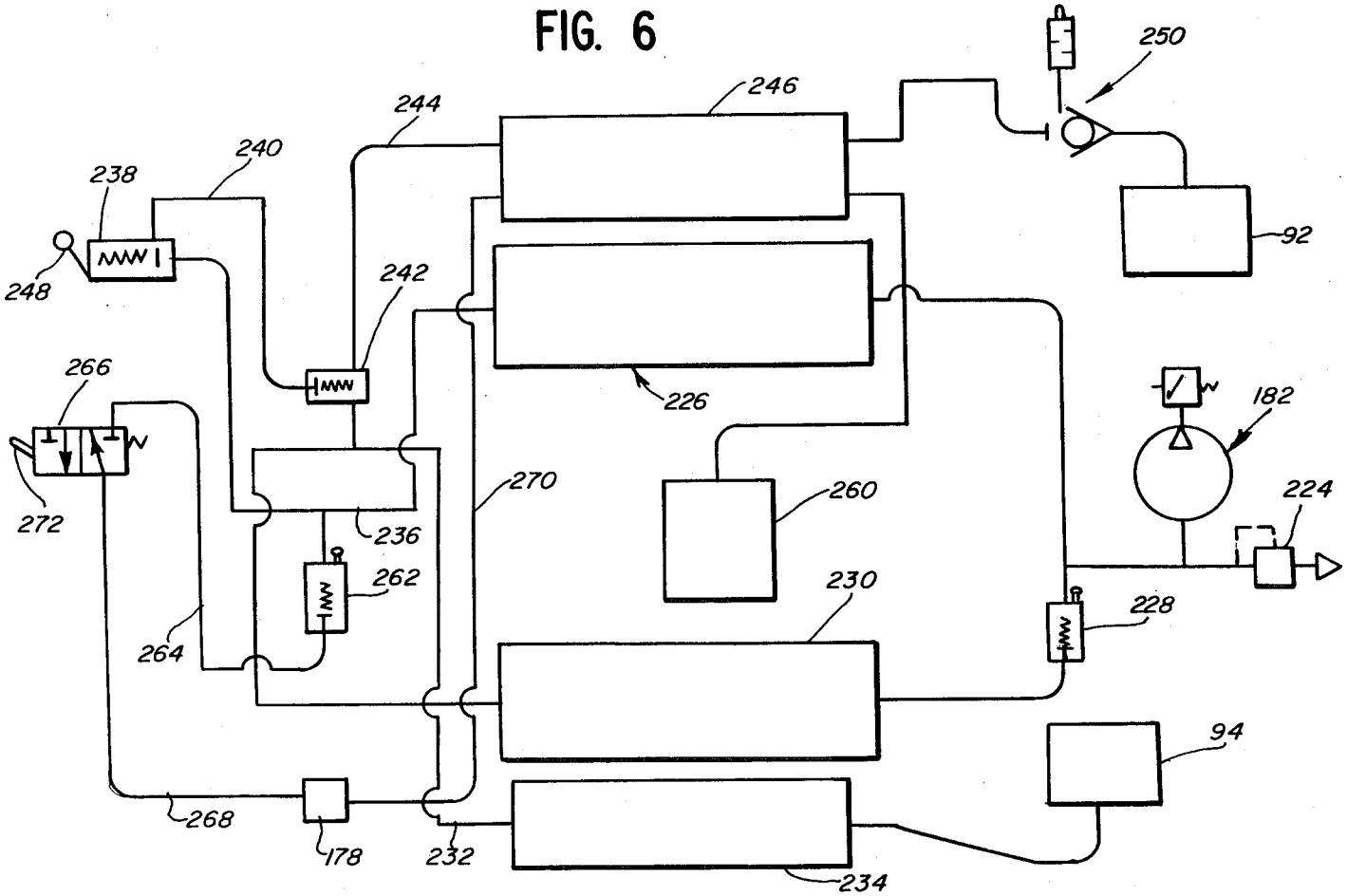
FIG. 6 is a schematic diagram of a pneumatic control system for controlling the various operations of the floor scrubbing and buffing machine of FIG. 1.

The operation of the combination floor scrubbing and polishing machine 10 is controlled by an electrical control system schematically shown in FIG. 5 in conjunction with a pneumatic control system schematically shown in FIG. 6 of the drawings. The floor scrubbing and polishing machine 10 may be powered by several different power sources. For example, machine 10 may be a self-contained unit with a bank of batteries 106 (shown schematically in FIG. 5) located in the housing unit 12. The bank of batteries 106 can be of any suitable voltage, but the batteries must be capable of supplying a fixed voltage between terminals 108 and 110 and the same fixed voltage between terminals 110 and 112 and have sufficient capacity to provide the requisite motive and control power for operation of the machine. For example in a 36 volt system, six 6-volt batteries could be used to power the floor treating machine 10. Three of those batteries could be hooked together in series to act as a battery 114 to supply 18 volts DC potential between terminals 108 and 110. In this case the positive terminal of the battery 114 would be connected to the terminal 108 and the negative terminal of the battery 114 would be connected to the terminal 110. Another set of three 6-volt batteries could form the battery 116 so that 18 volts DC potential is supplied between the terminals 110 and 112 with the positive terminal of the battery 116 being connected to the terminal 110 and the negative terminal of the battery 116 being connected to the terminal 112.

When an operator of the floor treating machine 10 wants to begin operation of the machine 10, switches 118 and 120 located on the control panel 22 are closed. In addition, if present, key operated switches 122 and 124 located on the control panel 22 also are closed. When the switches 118 and 122 are closed a pilot light 126 on the control panel 22 is energized to indicate that the machine 10 is on. A voltmeter 128 registers the voltage across the terminals 108 and 112 so that an operator knows if the battery bank 106 is fully charged. If the batteries 114 and 116 are not properly charged, an external battery charger (not shown) can be plugged in across the terminals 108 and 112. The charger is connected to an AC power source to recharge the batteries 114 and 116 in the battery bank 106. In an alternate embodiment, a battery charger can be built into machine housing 12 and connected to an external AC power source. In the event that an operator wants to physically check the batteries 114 and 116 in the bank 106, a convenience light 130 in the battery bank compartment located in the housing 12 can be energized through a resistor 132 by the closing of a light switch 134.

With the switches 118 and 120 and the switches 122 and 124 closed, the floor treating machine 10 can now be moved by the drive wheel 20. The control of the movement or steering of the floor treating machine 10 is primarily controlled by the operator through the control handles 24 located at the rear of the housing 12 adjacent the control panel 22. Normally, the control handles 24 are in an off position so that contacts 136, 138, 140 and 142 are open. When an operator pushes the control handles 24 forward, the contacts 136, 138 and 140 selectively are closed. If an operator moves the control handles 24 from its off position backwards away from the front of the housing 12, the floor treating machine 10 will move in the reverse direction since this movement of the control handles 24 selectively closes the contacts 142, 136 and 138. As will be described in more detail hereinafter, the closing of the contacts 136, 138, 140 and/or 142 selectively energizes relays 144, 146, 148 and/or 150 and 178 such that appropriate energizing voltages are supplied to the drive motor 36 (schematically shown in FIG. 5, but also shown in FIG. 3). Motor 36 is a DC motor. Those skilled in the art realize that varying the armature voltage of DC motors proportionately varies the speed. It is also known that by changing the polarity of the DC voltage to the armature will reverse the direction that the motor rotates. Therefore, depending upon the magnitude of the voltage and the polarity of the voltage applied to the motor 36, the drive wheel 20 will be rotated by the motor 36 to move the floor treating machine 10 in a forward direction at one of three speeds or in a reverse direction in one of two speeds.

In an alternate embodiment, voltage varying means for varying the voltage to the motor armature can be connected into the circuit to vary the motor speeds in infinitestimal steps.

More specifically, in order for an operator to have the floor treating machine 10 move along a floor, a parking brake (not shown) on the housing 12 must be disengaged which results in the closing of a switch 152. Assuming that a switch 154 has its contacts **154*a* and 154*b* closed as is shown in FIG. 5, the movement of the control handles 24 forward will close contacts 136 and the relay 144 is energized. The energizing of the relay 144 closes contacts 156 so that a relatively negative potential is supplied to a terminal 158 on the motor 36 through the closed contacts 156, the closed switch 120, normally closed contacts 160 and a resistor 162. A relatively positive potential will be applied to another terminal 164 of the drive motor 36 from the terminal 108 through normally closed contacts 166. Since the entire resistor 162 is in the circuit supplying power to the motor 36, the motor 36 will rotate at a relatively slow speed and in a direction to drive the drive wheel 20 so that the floor treating machine 10** will move in a forward direction.

If a slightly faster or medium forward speed is desired, the operator pushs the control handles 24 further forward so that not only will the contacts 136 be closed, but also the contacts 138 are closed. The closing of the contacts 138 energizes the relay 146 through the contacts **154*b* in the switch 154. When the relay 146 is energized, contacts 168 are closed and a relatively negative potential is supplied to the terminal 158 of the motor 36 through a tap 170 on the resistor 162 so that only a portion of the resistor 162 is in the circuit supplying potential to the motor 36. As a result, the motor 36 will increase in speed causing the drive wheel 20** to be rotated faster.

In order to increase the speed of the drive wheel 20 to move the floor treating machine 10 at its fastest speed, the operator pushs the control handles 24 even further forward closing the contacts 140 and energizing the relay 146 through the contacts **154*a*. Contacts 172 close and the relatively negative potential being supplied to the terminal 158 on the motor 36 no longer is being supplied through the resistor 162. As a result, the potential supplied to the motor 36 is increased and the speed of the motor 36** is also increased.

There are times that it is desired that an operator of the floor treating machine 10 should be able to move the floor treating machine 10 at a maximum medium or slow forward speed notwithstanding the position of the control handles 24. The switch 154 provides what might be termed a lock out feature such that when the floor treating machine 10 is to be moved at a relatively medium maximum velocity, the switch 154 is changed so that contacts **154*c* and 154*d* are closed instead of the contacts 154***a* and 154*b*. As a result of this change in the position of the lock out switch 154, the relay 148 cannot be energized so that the motor 36 is never supplied with sufficient potential to move the floor treating machine 10 at a speed greater than its medium forward speed. In the event that only the slowest forward speed is to be used, the operator positions the switch 154 so that none of the contacts 154*a*, 154*b*, 154*c* or 154*d* are closed and relays 146 and 148 will not be energized. As a result, only the lowest possible potential through the full resistor 162 can be applied to the motor 36.

In order for the operator of the floor treating machine 10 to reverse the direction of the floor treating machine 10, the operator pulls the control handles 24 rearwardly past the off position so that the contacts 142 are closed and the relay 150 is energized. With the relay 150 energized, the normally closed contacts 160 and 166 open and normally open contacts 174 and 176 close. In addition, the movement of the control handles 24 rearwardly closes the contacts 136 so that the relay 144 is also energized. As a result, a relatively negative potential is supplied through the contacts 156, the switch 120 and the contacts 174 to the terminal 164 on the motor 36. A relatively positive potential is supplied through the contacts 176 and the resistor 162 to the terminal 158 of the drive motor 36. Since this potential across the terminals 158 and 164 is opposite to the potential previously supplied to the motor 36 when the floor treating machine 10 was being moved in the forward direction, the motor 36 will rotate in the opposite direction so that the drive wheel 20 also will be rotated in the opposite direction and the floor treating machine 10 will move in the reverse direction.

If the speed of the floor treating machine 10 in the reverse direction is desired to be increased, the control handles 24 may be pulled backwards further thereby also closing contacts 138. As a result, the relatively positive potential being supplied to the terminal 158 through the closed contact 176 will now be supplied through the contacts 168 and the tap 170 on the resistor 162 so only a portion of the resistor 162 will be in the circuit supplying the relatively positive potential to the drive motor 36. Consequently, the potential across the motor 36 will be increased and the floor treating machine 10 will be put in a reverse mode at a higher speed.

The lock out switch 154 also can be used to limit the speed the floor treating machine 10 travels in the reverse direction. If the switch 154 is positioned so that all of the contacts 154*a*, 154*b*, 154*c* and, 154*d* are open, the relay 146 cannot be energized and only the slowest reverse speed can be attained.

Whenever the floor treating machine 10 is operated in the reverse direction by the closure of the contacts 142, energizing potential will also be supplied to a normally open solenoid 178 thereby closing the solenoid 178. As will be discussed in more detail in connection with the pneumatic control system shown in FIG. 6, the closing of the solenoid 178 results in the squeegee 28 being lifted off the floor surface so as to assure that the squeegee 28 does not inhibit the reverse movement of the floor treating machine 10.

As is also apparent, whenever the floor treating machine 10 is being operated in the forward or reverse direction, the contacts 136 are closed and if an hourmeter 180 is provided on the control panel 22 of the floor treating machine 10, the hourmeter 180 will be energized through the contacts 136 and show the number of hours that drive wheel 20 has been propelling the floor treating machine 10.

In order to provide air pressure to the pneumatic control system schematically shown in FIG. 6, a compressor 182 is provided in the housing 12 of the floor treating machine 10 and is energized by the closing of a switch 184. Whenever the switch 184 is closed, potential is applied to the compressor 182 through the switch 184, the closed switches 118 and 122 and a resistor 185.

The floor treating machine 10 has two modes of operation. In one mode of operation, the floor treating machine 10 is used as a floor scrubber and it is in this mode of operation that the brushes 44 and 46 should be rotated at a relatively slow speed by the motors 48 and 50, respectively. In its other mode of operation, the floor treating machine 10 is used as floor polisher or buffer and the brushes 44 and 46 should be rotated at a relatively high rotational speed by the motors 48 and 50, respectively. For example, when the floor treating machine 10 is used as a floor polisher, the brushes 44 and 46 may be rotated at approximately 900 revolutions per minute whereas when the floor treating machine 10 is used as a floor scrubber a rotational speed for the brushes 44 and 46 can be somewhere between 400 and 450 revolutions per minute. The speed at which the brush motors 48 and 50 rotate the brushes 44 and 46, respectively, is controlled by a switch 186. When the switch 186 is as shown in FIG. 5, contacts 186*a* and 186*b* are closed and the brushes 44 and 46 will be rotated at their high speed. In order to have the brushes 44 and 46 rotated at the lower speed, the switch 186 is changed so that contacts 186*c* and 186*d* are closed and the contacts 186*a* and 186*b* are opened. If the motors 48 and 50 are to be turned off, the switch 186 is positioned with all of the contacts 182*a*, 182*b*, 182*c* and 182*d* open.

Turning first to the situation when the brushes 44 and 46 are rotated at a relatively high speed in a floor buffing mode, the contacts 186*a* and 186*b* are closed and a positive potential is supplied through the contacts 186*a* to a relay 188 from the terminal 108 and a relatively negative potential is supplied to the relay 188 through the resistor 185 and the closed switches 118 and 122 from the terminal 112. As a result, the relay 188 is energized closing normally opened contacts 190. A terminal 192 of the motor 48 is then supplied with relatively positive potential from the terminal 108 through the closed contacts 190 and an ammeter 194. The other terminal 196 of the motor 48 is supplied with a relatively negative potential from the terminal 112 through normally closed contacts 198. With the potential so supplied to the motor 48, the motor 48 rotates the brush 44 in a clockwise direction as the brush 44 is viewed in FIG. 4. The positive potential from the terminal 108 is also supplied to a terminal 200 on the motor 50 through the closed contacts 190, the ammeter 194 and normally closed contacts 202. The terminal 204 on the motor 50 is directly coupled to the relatively negative potential terminal 112. With this potential being supplied to the terminals 200 and 204, the motor 50 rotates the brush 46 in a counterclockwise direction as the brush 46 is viewed in FIG. 4. In this manner, the brushes 44 and 46 are rotated in the opposite directions and since the full 36 volt potential across the terminals 108 and 112 is being supplied to both the motors 48 and 50, the motors 48 and 50 rotate the brushes 44 and 46, respectively, at a relatively high rotational speed.

When the floor treating machine is to be used as a floor scrubber, it is desired to have the brushes 44 and 46 rotate at a lower rotational speed and this is accomplished by closing the contacts 186c and 186d in the switch 182 instead of the contacts 186a and 186b. The closing of the contacts 182c energizes the relay 188. With the contacts 186d closed, a relatively positive potential is supplied to relays 206 and 208 through a resistor 210. A relatively negative potential is supplied through the resistor 185 and closed switches 118 and 122 to the relays 206 and 208 so as to energize the relays 206 and 208. The energizing of relay 188 results in the contacts 190 being closed, the energization of relay 206 results in the opening of the contacts 198 and the closing of contacts 212, and the energization of relays 208 results in the opening of the contacts 202 and the closing of contacts 214. Consequently, a relatively positive potential is supplied through the contacts 190 and the ammeter 194 to the terminal 192 on the motor 48. The terminal 196 on the motor 48 will be supplied with the potential appearing at the center tap 110 in the battery bank 106 through now closed contacts 212. As a result, a potential of 18 volts is supplied across the terminals 192 and 196 of the motor 48 and the motor 48 will be rotated at about half the rotational speed it was rotated when the potential of 36 volts was being supplied to the motor 48. The terminals 200 and 204 on the motor 50 also are being energized with an 18 volt potential. The terminal 204 is still coupled directly to the negative terminal 112 in the battery bank 106. The terminal 200 is now coupled to the central tap terminal 110 through the now closed contacts 214. As a result, the motor 50 will also rotate at a lesser rate of speed. The potential across the motors 48 and 50 is still in the same polarity as it was when the motors 48 and 50 were being supplied with 36 volts such that the brush 44 will be rotated in the clockwise direction and the brush 46 will be rotated in the counterclockwise direction as the brushes 44 and 46 are viewed in FIG. 4.

In an alternate embodiment, the speed of brush motors 48 and 50 is varied by varying resistances wired in series with the battery supply 106 or the motors 48 and 50.

During the operation of the floor treating machine 10 as a floor scrubber, cleaning solution from the solution portion of the tank 18 is supplied to the brushes 44 and 46. In order to accomplish this and as best seen in FIG. 4, a tube 216 is supported above the brush 44 and a tube 218 is positioned above the brush 46. The tubes 216 and 218 are supplied with a metered amount of cleaning solution used in scrubbing a floor surface by appropriate tubing or hosing (not shown) connected to the solution tank portion of the tank 18 so that the cleaning solution is sprayed onto the floor as the brushes 44 and 46 are rotated.

It is desirable during the operation of the floor treating machine 10 as a floor scrubber to collect and pick up the wet dirty cleaning solution with which the floor has been scrubbed by the brushes 44 and 46. The collecting of the dirty cleaning solution is accomplished by the squeegee assembly 16 at the rear of the housing 12. More specifically, the squeegee 28 collects the wet dirty solution and the operator of the floor treating machine 10 can deposit the wet dirty solution through the tube 30 into the recovery portion of the tank 18 by closing a switch 220 on the control panel 22. The closing of the switch 220 energizes a vacuum pump 222 which is associated with the tube 30 and which pumps the dirty solution through the tube 30 to the recovery portion of the tank 18.

The electrical control system schematically shown in FIG. 5 is used in conjunction with the pneumatic control system shown in FIG. 6 to regulate the position of the brush head subassembly 14 relative to the floor surface and to thereby regulate the force the brushes 44 and 46 exert against the floor surface. In addition, the force with which the squeegee 28 engages the floor is also regulated. More specifically, and with particular reference to the control system shown in FIG. 6, the pneumatic fluid pressure for the floor treating machine 10 is provided by the compressor 182 which is energized by the closing of the switch 184 on the control panel 22. The compressor 182 provides fluid (air) under pressure. For example, a relief valve 224 associated with the compressor 182 can regulate the pressure of the fluid from the compressor 182 to 80 psi. The pressurized fluid is supplied to a high pressure reservoir 226. An air regulator 228 connected to the output of the compressor 182 regulates the air being supplied to a low pressure reservoir 230. For example, the air pressure being supplied to the reservoir 230 can be approximately 8.7 psi.

When the floor treating machine 10 is turned on by the closing of the switches 118, 120, 122 and 124, the compressor 182 may be turned on by the closing of the switch 184. In the event that the speed control switch 186 is in its off position so that the motors 48 and 50 are not energized, the low pressure from the reservoir 230 will be supplied to the brush lift actuator 94 through a hose 232 extending through the right hand frame portion 234 of the housing 12. In addition, the high fluid pressure from the reservoir 226 is supplied through a hose 236, a brush valve assembly 238, a hose 240, normally closed solenoid 242 (shown schematically both in FIGS. 5 and 6) and a hose 244 extending through a left frame portion 246 of the housing 12 to the brush lift actuator 92. Solenoid 242 connects hose 240 to hose 244.

The brush valve assembly 238 has a cam lever 248 which upon manual movement by the machine operator through an infinite number of positions controls the amount of air pressure that is supplied from the reservoir 226 through the solenoid 242 to the actuator 92. As the pressure supplied from the high pressure reservoir 226 to the brush lift actuator 92 is increased under the control of the cam lever 248, the stem 96 connected to the arm section 78 will lift the arm 78 as viewed in FIG. 3 such that the brush housing 42 will be lifted away from the floor surface. The lifting of the brush housing 42 will be aided by the low pressure being supplied to the actuator 94 from the reservoir 230 because the stem 98 will place a lifting force on the arm section 80. Further increases of the pressure through the valve 238 to the brush lift actuator 92 will lift the brush housing 42 even more and it will tilt upwardly relative to the trailing edge 104 as described heretofore. When the brush housing 42 is so lifted, an operator has access to the brushes 44 and 46 so that the brushes 44 and 46 can be changed or the like.

In order to have the brushes 44 and 46 engage the floor, the cam lever 248 is manually pushed downwardly as seen in FIG. 6 decreasing the high pressure from the reservoir 226 to the brush lift actuator 92. When the pressure is lowered sufficiently a quick exhaust valve 250 is open so that the pressure in the brush lift actuator 92 is quickly exhausted from the brush lift actuator 92.

In order to place the floor treating machine 10 in its low speed scrub mode, the brush speed control speed switch 186 is altered to close the contacts 186*c* and 186*d*. The closing of the contacts 186*c* and 186*d* does not affect the condition of the brush solenoid 242 and the solenoid 242 remains closed. The brush lift actuator 94 is still provided with low pressure from the reservoir 230 through the hose 232. Likewise, the brush lift actuator 92 is provided with pressure from the reservoir 226 through the hose 236, the valve 238, the hose 240, the solenoid 242, and the hose 244. The amount of pressure supplied to the brush lift actuator 92 again is controlled by the movement of the cam lever 248 which controls the amount of pressure provided through the valve 238. Consequently, when the floor treating machine 10 is in its low speed scrub mode, the portion of the brush housing 42 relative to the floor and thereby the amount of force applied by the brushes 44 and 46 against a floor is infinitely adjustable by manually adjusting the cam lever 248 on the valve 238. The brushes 44 and 46 exert a maximum pressure against the floor when the cam lever 248 is adjusted so that essentially no pressure is applied to the brush lift actuator 92 or exert a minimum or zero pressure against the floor when the pressure from the reservoir 226 to the brush lift actuator 92 is increased.

When the floor treating machine 10 is to be operated in the high speed mode of the brushes 44 and 46 so that the floor treating machine 10 is used as a floor buffer, the cam lever 248 is automatically moved all the way down to its lowest position in FIG. 6 as the machine 10 is switched to the high speed mode. This cuts off the pressure being supplied from the reservoir 226 through the valve 238 and the quick exhaust valve 250 exhausts the air pressure in the brush lift actuator 92. The lowering of the cam lever 248 also closes a switch 252 (FIG. 5). When the brush speed control switch 186 is changed to its high speed position with the contacts 186*a* and 186*b* closed, positive potential is supplied from the terminal 108 through the contacts 186*b* and a resistor 254 to a timer relay 256. The timer relay 256 is also connected through the closed switch 252 to the relative negative potential of the terminal 112 through the resistor 185 and the closed switches 118 and 122. As a result the timer 256 is activated. After a predetermined period of time, such as approximately five seconds, contacts 258 are closed resulting in the opening of the brush solenoid 242.

As best seen in FIG. 6, the opening of the brush solenoid 242 permits the supplying of low pressure from the reservoir 230 to the brush lift actuator 92 by means of the hoses 232 and 244. In addition, low pressure from the reservoir 230 is also supplied to the brush lift actuator 94 through the hose 232. With both of the brush lift actuators 92 and 94 supplied with low pressure from the reservoir 230, the brush housing 42 is maintained at a constant level above the floor such that the brushes 44 and 46 contact the floor and exert a constant pressure against the floor. For example, when both the brush lifters 92 and 94 are supplied with the low pressure from the reservoir 230, the brushes 44 and 46 can exert 25 to 30 pounds pressure against the floor whereas when no pressure is supplied to the actuator 92, the brushes 44 and 46 exert about 80 pounds of pressure on the floor surface. Consequently, the pressure against the floor of the brushes 44 and 46 are maintained at a constant pressure during the high speed buffing mode due to the fact that upon the closing of the contacts 186*b* the brush solenoid 242 opens after a short time delay. The position of brushes 44 and 46 is automatically controlled such that brushes 44 and 46 apply a predetermined pressure and may not be varied by the operator as can be done in the scrubbing mode. This avoids too much pressure being applied by the brushes 44 and 46 during the high speed buffing mode that could overload the machine 10 resulting in failure.

In an alternate embodiment conduit means are used in place of hoses.

As noted above, the pneumatic control system also controls the engagement of the squeegee 28 with the floor surface. As is specifically shown in U.S. Pat. No. 4,293,971, the squeegee 28 is normally biased away from the floor surface by a spring mechanism (not shown for clarity). In order to force the squeegee 28 against the floor during the scrubbing mode of operation, a squeegee actuator 260 (FIG. 6) is provided. The squeegee actuator 260 is provided with pressure from the high pressure reservoir 226 through the hose 236, an air regulator 262, a hose 264, a squeegee control valve 266, a hose 268, normally open squeegee solenoid 178 and a hose 270 which extends through the left side frame 246 of the housing 12. Whenever the squeegee actuator 260 is provided with this air pressure, the squeegee 28 is forced towards the floor. The amount of force with which the squeegee 28 will engage the floor is controlled by a lever 272 on the squeegee valve 266 which controls the amount of pressure being supplied to the squeegee actuator 260. Consequently, the lever 272 on the valve 266 acts as a manual control of the engagement of the squeegee 28 with the floor. For example, the squeegee 28 would be manually placed in its up position when the floor treating machine 10 is not in a floor scrubbing mode. It is important that the squeegee 28 is not engaging the floor when the floor treating machine 10 is moved in a reverse direction. As a result, it is necessary to ensure that no air pressure is provided to the squeegee actuator 260 whenever the floor treating machine 10 is placed in a reverse direction. Accordingly, as discussed above with respect to the schematic diagram of FIG. 5, the solenoid 178 is automatically closed whenever the contacts 142 are closed in response to the floor treating machine 10 being placed in a reverse movement direction and the squeegee 28 will be lifted from engagement with the floor.

ALTERNATE EMBODIMENT

In an alternate embodiment, a high speed polishing machine is disclosed capable of attaining rotational brush speeds of 2000 RPM and over. The polishing machine is structurally similar to the combination scrubbing and polishing machine just described except the facilities relating to the scrubbing mode (e.g. squeegee, solution and recovery tank, etc.) are removed. The operation of the polishing machine 10 is controlled by an electrical control system shown schematically in FIG. 7 in conjunction with a pneumatic control system schematically shown in FIG. 8 of the drawings. Similar to the combination machine, the polishing machine may be powered by several different power sources.

Figure 7:
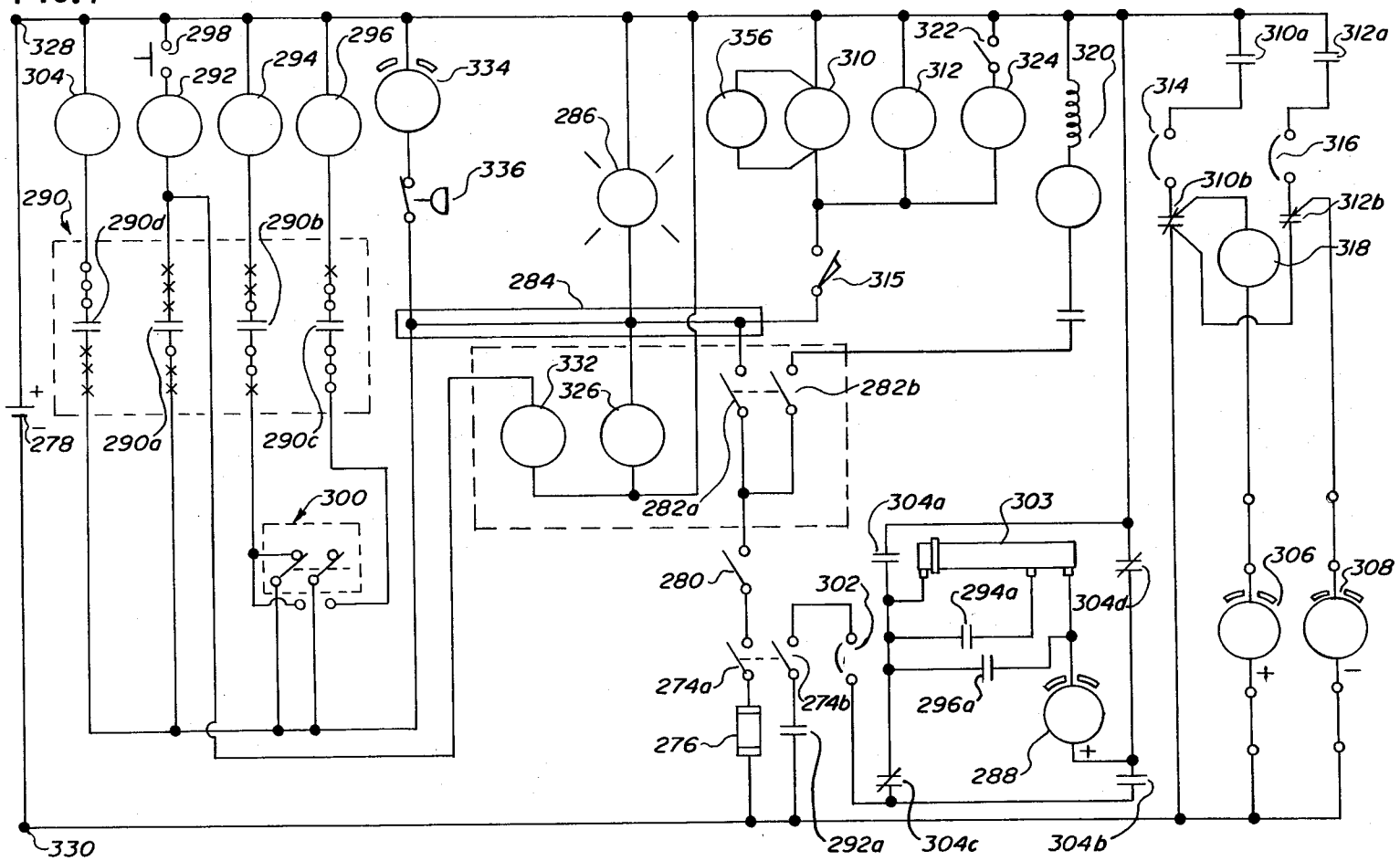
FIG. 7 is a schematic diagram of the electrical control circuit for controlling the operation of the floor polishing machine in accordance with another embodiment of the present invention.

Turning to FIG. 7, the machine is started by turning the master switch 274 to the "on" position. This switch is located on the control panel 22. The master switch 274 is a double pole 274*a* and 274*b* single throw switch. One side of one pole 274*a* is connected to one side of a fuse 276. The other side of this fuse 276 is connected to the negative of a battery 278. The other side of the one pole 274*a* of master switch 274 is connected to a security switch 280. The security switch 280 is a single pole, single throw switch which is wired in series with the master switch 274 and an optional keylock switch 282. The security switch 280 is normally closed and is also located on the control panel 22. This switch 280 is opened while maintenance is being performed to prevent inadvertant operation of the machine. The keylock switch 282 is optional and is located on the control panel 22. The keylock switch 282 is a double pole 282*a* and 282*b*, single throw switch. One pole 282*a* is connected between the security switch 280 and an electrical bus 284. The keylock switch 282 allows the key to be inserted into the switch in the "off" position. The key is then turned to the "on" position to start the machine 10. This feature is designed to prevent the machine 10 from being operated except by authorized personnel. An indicating light 286 is connected between the electrical bus 284 and the positive side of a battery 278. When the contacts of the master switch 274, the security switch 280 and the keylock switch 282 are all closed, the indicating light 286 will illuminate. The indicating light 286 is located on the control panel 22 and indicates that electrical power is connected to the control circuit.

Once electrical power is connected to the control circuit, the machine 10 is propelled across the floor by a traverse motor 288. The machine is capable of being propelled at three forward speeds and one reverse speed. The speed and direction of the traverse motor 288 is controlled by a pair of control handles 24 located on the control panel 22. The control handles 24 are used to actuate a cam operated switch 290. This switch 290 has four contacts 290*a*, 290*b*, 290*c* and 290*d*, each of which will be either open or closed depending on the position of the cam assembly (integral to the switch), which is capable of seven positions. These positions correspond to three forward speeds, a neutral position in which all contacts are opened, and reverse speed. Two positions are not used.

One side of the four switch contacts 290*a*, 290*b*, and 290*c* is connected to a set of three forward contactors 292, 294, and 296. Two of these contactors 294 and 296 are also connected to the positive side of the battery 278. The other contactor 292 is serially connected to a brake switch 298, the other side of which is connected to the positive of the battery 278. The brake switch 298 is a normally closed, single pole, single throw switch, which is actuated by depressing the parking brake (not shown). When the parking brake is engaged, the brake switch 298 is open and prevents the traverse motor 288 from receiving electrical power.

Two contacts, 290*b* and 290*c*, are serially connected to two of the contactors, 294 and 296 respectively, and the speed switch 300. The speed switch 300 is a double pole, double throw switch and is a three position switch wherein, in the "fast" position connects one contactor 296 to electrical bus 284. In the "medium" position a second contactor 294 is connected to the electrical bus 284 and the third contactor 296 is disconnected.

Two contacts of the forward contactor, 294*a* and 296*a*, are wired across portions of a resistor 302 which is wired in series with the traverse motor 288. As understood by those skilled in the art, the speed of a DC motor can be varied by changing the voltage applied to the motor terminals. This can be done in several ways. One way is as illustrated in FIG. 7 by wiring a resistor 302 in series with the motor 288. One contact 296*a* is wired across the resistor 302. When this contact 296*a* is closed, the resistor 302 is effectively shorted and full battery voltage is applied to the terminals of the motor 288. This would correspond to the "fast" speed mode. Another contact 294*a* is wired across a portion of the resistor 302. In this mode only a portion of the resistance of the resistor 302 is connected in series with the motor 288. The other portion is effectively shorted. This condition corresponds to the "medium" speed mode. When both of the contacts 294*a* and 296*a* are open, the full resistance of the resistor 302 is connected in series with the motor 288. This condition corresponds to the "slow" speed mode.

A third forward contactor contact 292*a* is connected between the negative side of the battery 278 and one side of the master switch contact 274*b*. The other side of the master switch 274*b* is connected in series to a circuit breaker 302 which is operatively connected to the positive side of the motor 288. The negative side of the motor 288 is operatatively connected to the positive side of the battery 288.

The master switch contact 274*b* functions to isolate the traverse motor 288 from the power source when the master switch 274 is in the "off" position. The circuit breaker 302 provides overload and short circuit protection for the traverse motor 288.

The direction of the traverse motor 288 can be reversed. Those skilled in the art know that a DC motor can be operated in reverse by switching the polarity of the battery to the terminals of the motor. The present invention utilizes a control circuit for reversing the direction of the traverse motor 288 comprising a reversing relay 304 and four contacts 304*a*, 304*b*, 304*c*, and 304*d*. One side of the reversing relay 304 is connected to the positive side of the battery 278. The other side is serially connected to a contact 290*d* of the cam switch 290. This contact is open in the "forward" and "neutral" positions and closed in the "reverse" positions. This contact is wired to the electrical bus 284.

Two of the reversing contacts 304*a* and 304*b* are normally open and two 304*c* and 304*d* are normally closed. These four contacts 304*a*, 304*b*, 304*c*, and 304*d* are operatively connected to the motor 288 and the resistor 302 such that in the forward mode, the positive side of the motor 288 is connected to the positive side of the battery 278 and the negative side of the motor 288 is connected to the negative side of the battery 278. During this mode, electrical current flows from the battery through one contact 304*d* and into the positive side of the motor 288 and returns to the negative side of battery 278 through another contact 304*c*. When it is desired to reverse the direction of the traverse motor 288, the operator pulls back on the control handle 24 which closes one contact 290*d* and energizes a reversing relay 304. When the reversing relay 304 is energized, two contacts 304*c* and 304*d* open and two contacts 304*a* and 304*b* close. During this mode, electrical current from the battery 278 flows through one contact 304*a* and into the negative terminal of the motor 288. The current exits the positive terminal of the motor 288 and flows through another contact 304*b* and returns to the negative side of the battery 278.

Two brushes 44 and 46 are operatively connected to two electric drive motors 306 and 308. These motors are controlled by two brush motor contactors 310 and 312 which are connected in parallel with each other and are connected on one side to the positive of the battery 278 and on the other side to a brush switch 315, located on control panel 22. The brush switch 315, which is a single pole, single throw switch, is connected to the electrical bus 284. Once the brush switch 315 contact is closed, the brush contactors 310 and 312 are energized.

The brush contactors 310 and 312 each have normally open contact 310*a* and 312*a* and a normally closed contact 310*b* and 312*b*. The normally open contacts 310*a* and 312*a* are connected between the positive side of the battery 278 and two circuit breakers 314 and 316. The load sides of the circuit breakers 314 and 316 are connected to one side of the brush motors 306 and 308. The other side of the brush motors 306 and 308 is connected to the negative side of the battery 278. Thus, when the contactors 310 and 312 are energized, electrical power is delivered to the brush motors 306 and 308.

An ammeter 318 may be placed in series between one circuit breaker 314 and one brush motor 306 or between the second circuit breaker 316 and the other brush motor 308. This ammeter 318 is used to indicate current to the brush motors 306 and 308. In a machine such as the one disclosed in the instant invention, the armature current will be proportional to the brush contact pressure against the floor. The higher the contact pressure, the more armature current will be drawn. Since the brush contact pressure is variable the ammeter 318 will serve as an invaluable aid to an operator providing information to prevent unnecessary tripping of the circuit breakers 314 and 316.

The brush motors 306 and 308 can also be wired with what is known in the art as a dynamic braking circuit. Although there are several embodiments of dynamic braking circuits all of which are adaptable to the instant invention, herein described is one embodiment as illustrated in FIG. 7. Two contacts 310*b* and 312*b*, normally closed, are connected to the brush motors 306 and 308. When the contacts are opened by energization of their respective contactors 310 and 312, they function to isolate the brush motors 306 and 308 from the positive side of battery 278 and also connect the motors together in parallel. As is known in the art, the armature voltage is proportional to the speed of a DC motor. When a load is disconnected from a DC circuit and the armature circuit opened, a voltage can be read across the armature terminals. This voltage is a result of the stored energy in the rotating armature and driven load. This energy can be dissipated by connecting a resistance across the armature once electric power is disconnected. This will cause a voltage drop in the resistor due to circulating circuit between the motor and the resistor and thus reduce the speed since the speed is proportional to the reduced armature voltage. Another way to dynamically brake DC motors is once the motors are disconnected from the electric power source, connect the motors together. This will cause a circulating current which will produce voltage drops in connecting wire and series windings, thereby dissipating rotational energy. It is also known to those skilled in the art that a combination of the aforementioned techniques can be used. The present invention may also be utilized with other types of braking such as, electrical regenerative braking means and mechanical-type braking means.

A vacuum motor 320 is used to pick up dust and other particulate from the floor. A vacuum switch 322 is contained on the control panel 22. This switch is a single pole, single throw switch, which allows the operator to energize the vacuum contactor 324, which is serially connected to the vacuum switch 322. The series combination of the contactor 324 and the switch 322 is connected in parallel across the brush contactors 310 and 312. Once the vacuum contactor 324 is energized, a contact therefrom 324*a* will energize the vacuum motor 320, if the keylock 282 is in the "on" position. A contact 282*b* from the keylock switch is wired in series with the vacuum contactor contact 324*a*.

An optional voltmeter 326 is located on control panel 24 and provides the operator with the voltage level of the power source. Normally the machine 10 is self-contained and powered from a battery 278. Two terminals 328 and 330 allow for an alternate battery changer (not shown) source to be connected which can be used to charge the battery 278. The voltmeter 326 will indicate voltage level of either the battery or the charger provided the master switch 274, the security switch 280 and the keylock switch 282 are all closed.

Another option is an hourmeter 332. The hourmeter 332 records the time which the machine is on and the parking brake (not shown) is disengaged. The brake switch 298 is normally closed and is wired in series with hourmeter 332. The brake switch 298 opens when the parking brake is engaged.

Figure 8:
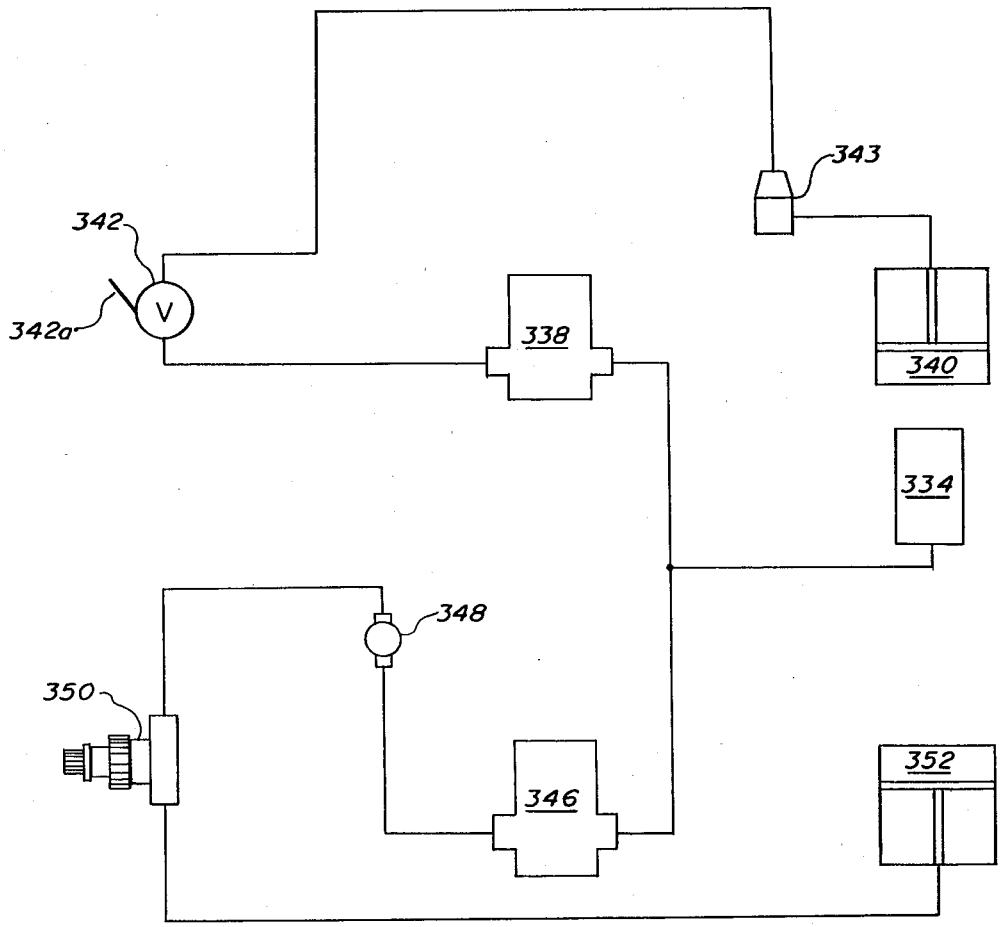
FIG. 8 is a schematic diagram of the pneumatic control system for controlling various operations of the floor polishing machine of FIG. 7.

The pneumatic control system is illustrated in FIG. 8. The system operates to lift the brush housing 42 away from the floor and vary the contact pressure of brushes 44 and 46 to the floor. Air pressure for the pneumatic control system is supplied by an air compressor 334. The air compressor motor 334 is connected in series with a pressure switch 336 which closes on low air pressure and starts the compressor 334.

The pneumatic control system is comprised of two independent control loops. One loop is for raising and lowering the brush housing 42 from the floor. The major components of this loop consists of a reservoir 338, a brush lift cylinder 340, a manual valve 342 and quick exhaust valve 343, all interconnected by tubing to the air compressor 334. The second loop comprises a reservoir 346, a normally closed solenoid valve 348, an adjustable air regulator 350 and a brush lift cylinder 352 all interconnected by tubing to the air compressor 334.

Both brush lift cylinders 340 and 352 are structurally connected to the machine 10 similar to the two cylinders 92 and 94 in the combination machine previously described. One brush lift cylinder 340 is used to lift the housing 42 away from the floor when the machine 10 is not being used in the polishing mode and is merely transported. The air compressor 334 is actuated by a low pessure switch 336 and is energized when the master switch 274 is turned on and the keylock switch 282 and the safety switch 280 are both closed. The compressor 334 provides the necessary air pressure to the lift cylinder 340 to raise the brush housing 47.

The brush housing 42 weighs approximately 140 pounds. In order to lift the brush housing 42 from the floor, enough air pressure from the air compressor 334 must be supplied to the brush lift cylinder 340 to overcome 140 pounds of weight. Compressed air is then accumulated in the reservoir 338. The air compressor 334 in conjunction with its reservoir 338 provide air pressure to the brush lift cylinder 340 to raise the brush housing 42. A cam actuated valve 342, which has a control lever 342*a*, is used to actuate a brush switch 314. When the valve lever 342*a* is placed in the upward postion, the valve 342 opens and allows compressed air pressure to one brush lift cylinder 340. The valve lever 342*a* is infinitely variable. When it is moved downward all the way, the valve 342 closes. This allows air pressure relief through a quick exhaust valve 343 and allows the brush housing 42 to be lowered since the air pressure is no longer able to oppose the gravity weight of the brush housing 42.

The second independent pneumatic control loop is used to vary the contact pressure of the brushes 44 and 46 against the floor. This loop is comprised of a reservoir 346, a solenoid valve 348, an adjustable air regulator 350 and a second brush lift cylinder 352 which are connected to the air compressor 334 by means of tubing.

When the valve lever 342*a* is pushed up, the brush switch 315 opens and de-energizes the brush contactors 310 and 312 which in turn disconnects electric power from the brush motors 306 and 308. When the valve lever 342*a* is pushed down, the brush motors are energized. A normally closed solenoid valve 356, which is wired in parallel with the brush contactors 310 and 312 opens when energized to allow compressed air to flow from the air compressor 334 through the second reservoir 346 to an adjustable air regulator 350. The air regulator 350 regulates air pressure to a second brush lift cylinder 352 such that the brush contact pressure against the floor is adjustable within a preselected range. In the preferred embodiment air pressure is regulated such that contact pressure can be regulated between 3 and 12 pounds.

The second brush lift cylinder 352 functions similar to the other brush lift cylinder 340. Air pressure may be varied by adjusting the knob on the air regulator 350. An ammeter 318 on control pannel 22, provides the operator with visual information as to the proper setting for contact pressure.

It is understood by those skilled in the art that pneumatic system, herein described as capable of pressurized fluid system embodiment. Among other things, compressor 334 would have to be substituted with a hydraulic pump.

Thus it should be apparent that unique floor maintenance machine has been disclosed. While the invention is described in conjunction with several embodiments, it should be evident that there are many alternatives, modifications and variations which will be apparent to those skilled in the art of the foregoing description. For example, in FIG. 7, resistors can be added to the dynamic braking circuit to reduce brush motor coastdown time. Accordingly, it is intended to cover all such alternatives (modifications and variations within the spirit and scope of the appended claims.

What is claimed and sought to be secured by Letters Patent of the United States is:

1. A floor treating machine, comprising:

a frame;

a brush housing operatively connected to said frame;

a rotatable brush for treating the floor; and means for positioning said brush with respect to the floor, said means for positioning said brush with respect to the floor further including means for regulating the contact pressure of the brush with respect to the floor.

2. The floor treating machine as defined in claim 1, wherein said means for regulating the contact pressure of the brush with respect to the floor is adjustable dependent on brush speed.

3. A machine for treating a smooth surface such as a floor or the like, comprising:

a frame structure;

a housing operatively connected to said frame structure;

a brush, rotatably connected to said housing, for treating the floor;

means for positioning said housing, for lifting said housing away from the smooth surface to be treated and lowering said housing toward the smooth surface to be treated; and means for controlling said means for positioning said housing, said means for controlling said means for positioning said housing constructed and arranged to provide a relatively constant contact pressure of said brush relative to said floor while said brush is rotated.

4. The machine as defined in claim 3, wherein said means for controlling said means for positioning said housing includes a manual control for adjusting the position of said brush relative to the smooth surface to be treated.

5. The machine as defined in claim 3, further including at least one brush motor having a predetermined coastdown time when electrical power is disconnected therefrom and said brush is moved out of contact with the smooth surface to be treated thereby removing the load on said motor, said motor being operatively connected to said brush for rotating said brush.

6. The machine as defined in claim 5, further including a dynamic brake for altering said predetermined coastdown time when said brush is moved out of contact with the surface to be treated.

7. The machine as defined in claim 3, wherein said brush is operatively connected to a first electric motor, said first electric motor having a predetermined motor coastdown time when the load is removed from said motor and when electrical power is disconnected therefrom, said predetermined motor coastdown time of said first electric motor being controlled by means for braking said first electric motor.

8. The machine as defined in claim 7, wherein said means for braking said first electric motor is provided by operatively connecting said first electric motor to a second electric motor after electrical power has been disconnected from said first motor and said second motor.

9. The machine as defined in claim 7, wherein said means for braking said first electric motor include at least one resistor operatively connected across said first electric motor.

10. The machine as defined in claim 3, wherein said means for controlling said means for positioning said housing includes:

a source of compressed air;

a first reservoir for accumulating compressed air, said first reservoir operatively connected to said source of compressed air;

means for controlling the flow of compressed air operatively connected to said first reservoir for controlling the release of compressed air from said first reservoir;

a first air cylinder operatively connected to said source of compressed air for receiving compressed air from said means for controlling the flow of compressed air so that said first cylinder may be used to raise or lower said housing relatively to said smooth surface to be treated based upon the pressure of the compressed air contained in said first cylinder;

a second reservoir for accumulating compressed air, said second reservoir operatively connected to said source of compressed air;

an air flow regulator operatively connected to said second reservoir for regulating the pressure of compressed air discharged form said second reservoir; and a second air cylinder, operatively connected to said air flow regulator for receiving compressed air from the outlet of said air flow regulator, so that said second air cylinder may be used to vary the contact pressure of said brush relative to to smooth surface to be treated based upon the pressure of the compressed air contained therein.

11. The machine as defined in claim 10 wherein said air flow regulator is adjustable.

12. The machine as defined in claim 10, wherein said means for controlling the flow of compressed air is controlled by a manually operated lever.

13. A machine for treating a smooth surface such as a floor, comprising:

a frame;

a housing operatively connected to said frame;

at least one brush rotatably connected to said housing;

means for positioning said housing operatively connected to said housing for selectively lifting said housing away from the smooth surface and lowering said brush towards the smooth surface;

a source of compressed air, disposed in said frame; and means for controlling said means for positioning said housing operatively connected to said source of compressed air to enable said means for positioning said housing to raise and lower said housing to maintain substantially constant pressure of the brush relative to the smooth surface while said brush is being operated.

14. The machine as defined in claim 13, wherein said means for controlling said means for positioning said housing permits adjustable positioning of said housing relative to said the smooth surface.

15. The machine as defined in claim 14, wherein said means for controlling said means for positioning said housing permits adjustable variation of the contact pressure of said brush relative to the smooth surface.

16. The machine as defined in claim 15, wherein the contact pressure of said brush relative to the smooth surface can be varied between 0 and 20 pounds.

17. A floor treating machine comprising:

a frame structure;

a housing operatively connected to said frame structure, means for treating the floor operatively connected to said housing;

means for lifting and lowering said means for treating the floor operatively connected to said housing;

a source of pressurized fluid; and means for controlling said means for selectively lifting and lowering said means for treating the floor operatively connected to said source of pressurized fluid to enable said means for lifting and lowering said means for treating said floor to position said means for treating the floor substantially vertically with respect to the floor and to regulate the contact pressure of said means to treat the floor against said floor to a substantially constant level while said means to treat the floor is operating.

* * * * *